US010092111B2

(12) United States Patent
Selle et al.

(10) Patent No.: US 10,092,111 B2
(45) Date of Patent: Oct. 9, 2018

(54) TUFTING BUTTON AND LOCKING MEMBER

(71) Applicant: STAFAST PRODUCTS, INC., Painesville, OH (US)

(72) Inventors: Stephen R. Selle, Mentor, OH (US); Shannon R Vargas, Mentor, OH (US)

(73) Assignee: Stafast Products, Inc., Painesville, OH (US)

( * ) Notice: Subject to any disclaimer, the term of this patent is extended or adjusted under 35 U.S.C. 154(b) by 0 days.

(21) Appl. No.: 14/723,997

(22) Filed: May 28, 2015

(65) Prior Publication Data

US 2016/0345747 A1 Dec. 1, 2016

(51) Int. Cl.
*A47C 31/02* (2006.01)

(52) U.S. Cl.
CPC ..... *A47C 31/026* (2013.01)

(58) Field of Classification Search
CPC ..... A47C 31/026; Y10T 24/3645; Y10T 24/3681; Y10T 24/366; Y10T 24/367; Y10T 137/7043; Y10T 24/1498; Y10T 24/36; Y10T 24/3685; Y10T 24/3689; Y10T 24/3691; Y10T 24/44077; Y10T 24/44248

See application file for complete search history.

(56) References Cited

U.S. PATENT DOCUMENTS 1,867,041 A * 7/1932 Walters ..... A47C 31/026 24/108
2,233,997 A * 3/1941 Dubick ..... A47C 31/026 24/102 T
2,910,116 A * 10/1959 Runge ..... A47C 31/026 24/114.3
3,500,506 A * 3/1970 Mitchell ..... A44B 1/12 24/102 T
3,591,876 A * 7/1971 Swindlehurst ..... A47C 31/026 24/102 T
3,608,157 A * 9/1971 Molt ..... B68G 7/08 223/102
3,780,400 A * 12/1973 Hinsperger ..... A44B 1/185 24/114.7
3,807,800 A * 4/1974 Morrison ..... A47C 31/026 297/452.23
3,816,881 A * 6/1974 Van Riper, Jr. ..... B68G 7/08 24/114.3
4,037,296 A 7/1977 White et al.
4,570,306 A * 2/1986 Eyler ..... B68G 7/08 24/102 T
4,970,766 A * 11/1990 Hsiau ..... A44B 1/28 24/108

(Continued)

*Primary Examiner* — Robert Sandy
*Assistant Examiner* — David M Upchurch
(74) *Attorney, Agent, or Firm* — Woodling, Krost and Rust

(57) ABSTRACT

A tufting button and locking member, in combination with a furniture cushion and fabric thereover wherein the tufting button includes a head and an elongated shaft. The elongated shaft includes a ratchet portion. The ratchet portion includes a plurality of ridges therein. The locking member includes a pawl. The elongated shaft of the tufting button is inserted into and through the furniture cushion and fabric thereover. The elongated shaft resides, partially, within the locking member. A portion of the plurality of ridges engages the pawl of the locking member compressing the furniture cushion.

10 Claims, 13 Drawing Sheets

(56) References Cited

U.S. PATENT DOCUMENTS

| | | | | | |
|---|---|---|---|---|---|
| 5,687,456 | A * | 11/1997 | Chang | H02G 3/26 | 24/16 PB |
| 6,185,792 | B1 * | 2/2001 | Nelson | B65D 63/1072 | 24/16 PB |
| 7,370,663 | B2 * | 5/2008 | Lundeberg | F16K 27/12 | 137/371 |
| 7,850,700 | B2 * | 12/2010 | Sakura | A61B 17/0482 | 606/144 |

* cited by examiner

TUFTING BUTTON AND LOCKING MEMBER

FIELD OF THE INVENTION

The invention is in the field of tufting buttons and locking members.

BACKGROUND OF THE INVENTION

U.S. Pat. No. 4,037,296 to White et al., issued Jul. 26, 1977, discloses a method and article for reinforcing the holes made through non-woven material; particularly vinyl, suede and leather, used in tufting upholstery and the like, and an article of manufacture embodying same.

SUMMARY OF THE INVENTION

A tufting button and locking member is disclosed. A tufting button and locking member in combination with a furniture cushion and fabric thereover is also disclosed. A tufting button and locking member in combination with a furniture cushion and fabric thereover, and further in combination with a frame member is also disclosed. The tufting button includes a head and an elongated shaft. The elongated shaft includes a ratchet portion, and the ratchet portion includes a plurality of ridges therein. The locking member includes a pawl. The elongated shaft resides, partially, within the locking member. A portion of the plurality of ridges engages the pawl of the locking member. Preferably the tufting button is plastic and the locking member is plastic.

The locking member is flange shaped meaning it is generally circularly shaped in cross section and has a thickness making in generally it the shape of a thin cylinder. The elongated shaft includes a protrusion thereon and the protrusion of the elongated shaft is a stop limiting the depth of insertion of the elongated member into the pawl of the locking member.

The locking member includes a centrally located pawl housing and the pawl resides within the centrally located pawl housing. Also, the centrally located pawl housing includes a gap therein enabling the pawl to move in response to adjustment of the plurality of ridges of the ratchet portion of the shaft of the tufting button relative to the pawl. A portion of the plurality of ridges engages the pawl of the locking member compressing the furniture cushion.

The locking member is a flange, the elongated shaft includes a protrusion thereon, and the protrusion of the elongated shaft is a stop limiting the depth of insertion of the elongated member into the pawl of the locking member thus limiting the extent of compression of the furniture cushion. The furniture cushion is trapped between the button head of the tufting button and the flange of the locking member. The centrally located pawl housing includes a gap therein enabling the pawl to move in response to adjustment of the plurality of ridges of the ratchet portion of the shaft of the tufting button relative to the pawl as the ridges are inserted into and through the pawl housing.

The frame member supports the furniture cushion and fabric which covers the furniture cushion. An attachment string adjustably connects the locking member and the frame member together to position the tufting button relative to the furniture cushion and fabric which covers the furniture cushion.

A process for positioning a tufting button and a locking member in furniture fabric residing over a cushion, the tufting button includes a head and an elongated shaft, the elongated shaft includes a ratchet portion, the ratchet portion includes a plurality of ridges therein, the locking member includes a pawl, and the furniture fabric is supported by the cushion and a furniture frame, comprising the steps of: puncturing a hole in the furniture fabric and the cushion; inserting the elongated shaft into and through the hole in the furniture fabric and the cushion; inserting the ratchet portion of the elongated shaft into and through the pawl of the locking member; locking the elongated shaft of the tufting button with the pawl of the locking member, the elongated shaft resides, partially, within the pawl of the locking member; compressing the furniture cushion, and, a portion of the plurality of ridges engages the pawl of the locking member; and, engaging the stop of the elongated shaft with the flange limiting the depth of insertion of the elongated shaft into the pawl of the locking member thus limiting the extent of compression of the furniture cushion.

It is an object of the present invention to provide a tufting button and locking member, wherein the tufting button includes a head and an elongated shaft, and the elongated shaft includes a ratchet portion, and the ratchet portion includes a plurality of ridges therein, and the locking member includes a pawl, and the elongated shaft resides, partially, within the locking member; and, a portion of the plurality of ridges engages the pawl of the locking member.

It is an object of the present invention to provide a pawl having teeth which engages the ridges of the ratchet portion of the elongated shaft of the tufting button.

It is object of the present invention to provide a tufting button and elongated shafting extending therefrom wherein the elongated shaft includes a stop/protrusion thereon for interengaging a flange member.

It is an object of the present invention to provide a tufting button and locking member for trapping at least one cushion therebetween, and compressing at least one cushion therebetween to a desired depth.

DETAILED DESCRIPTION OF THE INVENTION

Figure 1:
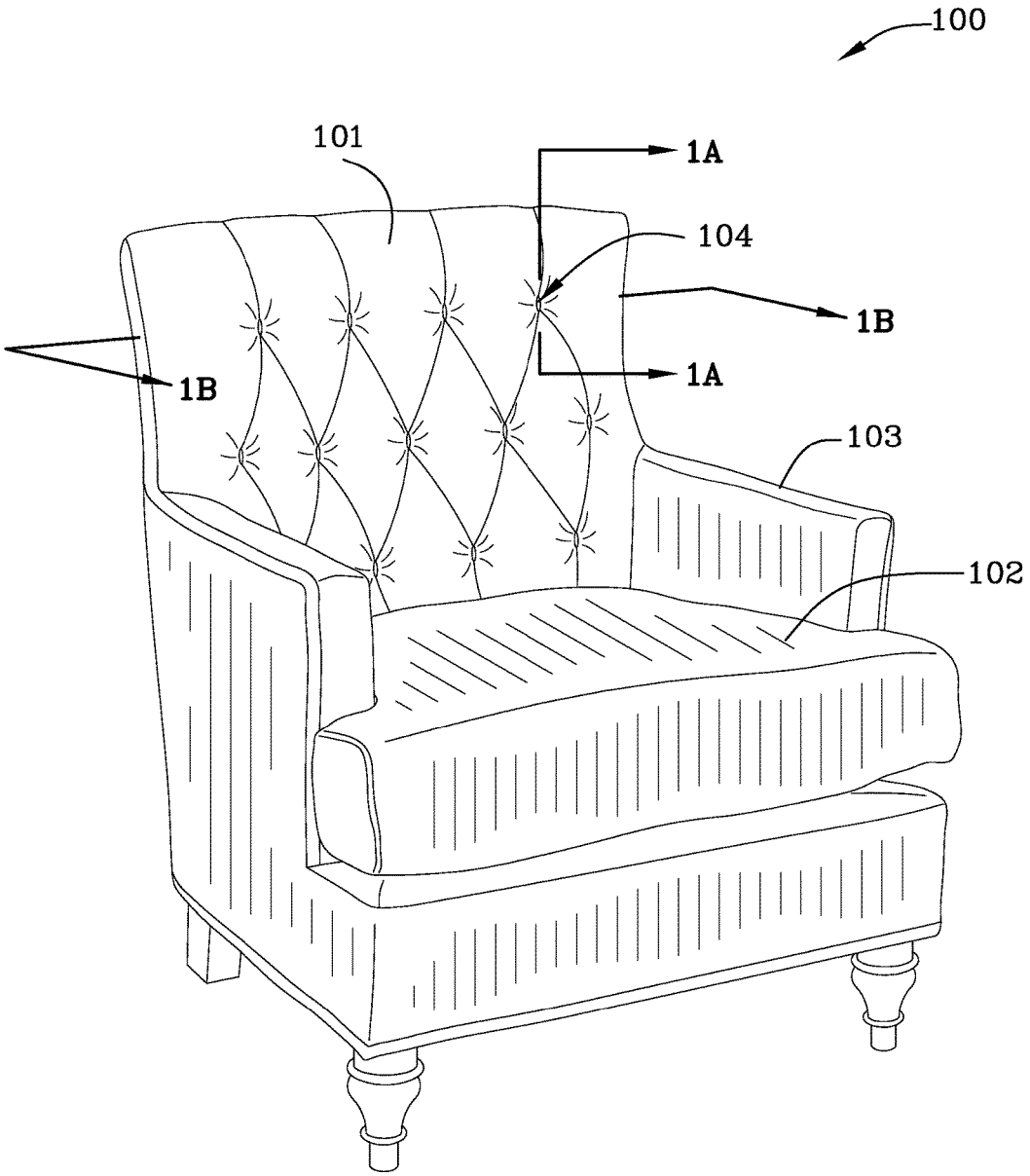
FIG. 1 is a perspective view of a chair.

FIG. 1 is a perspective view 100 of a chair. The upholstery fabric 101 is shown on the back of the chair, the upholstery fabric 102 is shown on the seat of the chair, and the upholstery fabric 103 is shown on the chair rail. Arrow 104 indicates a tufted region of the back of the chair.

Figure 1A:
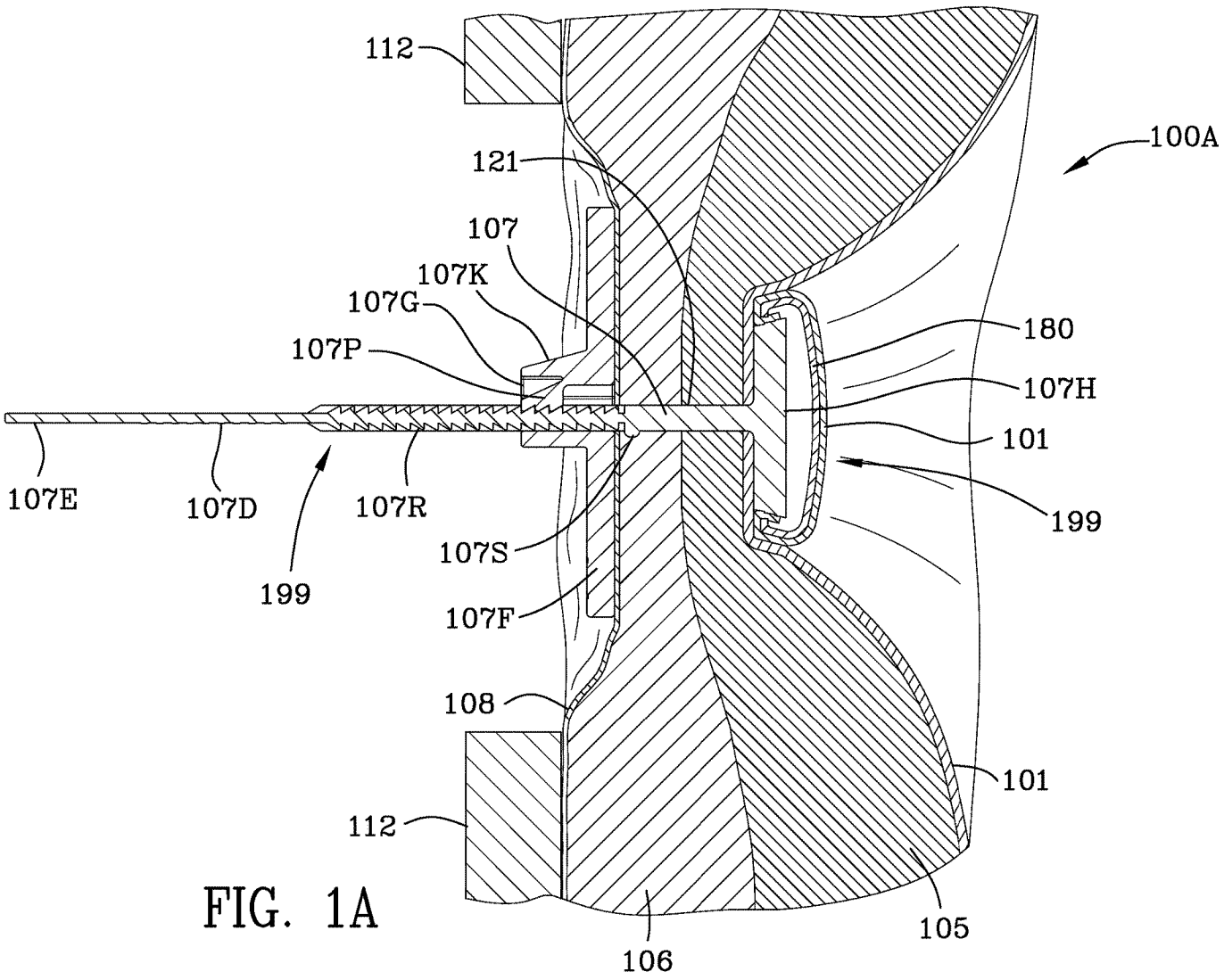
FIG. 1A is a cross-sectional view taken along the lines 1B-1B of FIG. 1.

FIG. 1A is a cross-sectional view 100A taken along the lines of FIG. 1. First foam pad 105 and second foam pad 106 are illustrated in FIG. 1A. Reference numeral 121 represents a hole or passageway for the shaft 107 through first foam pad/cushion 105 and second foam pad/cushion 106. Arrow 199 indicates the tufting button which includes a head portion 107H, a shaft portion 107, a protrusion/stop 107S on the shaft, a ratchet portion having ridges 107R on the shaft, and the narrow threading end portion 107E of shaft 107. Reference numeral 107D signifies depressions in the shaft 107 which can be used for gripping the narrow threading end portion 107E of shaft 107.

FIG. 1A also illustrates button locking member 107F, gap 107G allowing space for pawl 107P movement, pawl portion 107P of the button locking member 107F, and housing 107K extending from flange 107F. Frame 112 is shown supporting backing fabric 108, second cushion/pad 106, first cushion/pad 105, and exterior fabric/upholstery 101. Foam pads 105, 106 may be any commercially available materials for supporting furniture back pieces, railings and seats. Foam pads 105, 106, fabric 101, and working fabric 108 are secured between button head 107H and flange 107F. Pawl 107P engages teeth/ridges 107R on the shaft 107 and prevents rightward extraction of button head 107H when viewing FIG. 1A. Stop 107S limits the depth of insertion of the shaft 107 into flange 107F.

Figure 1B:
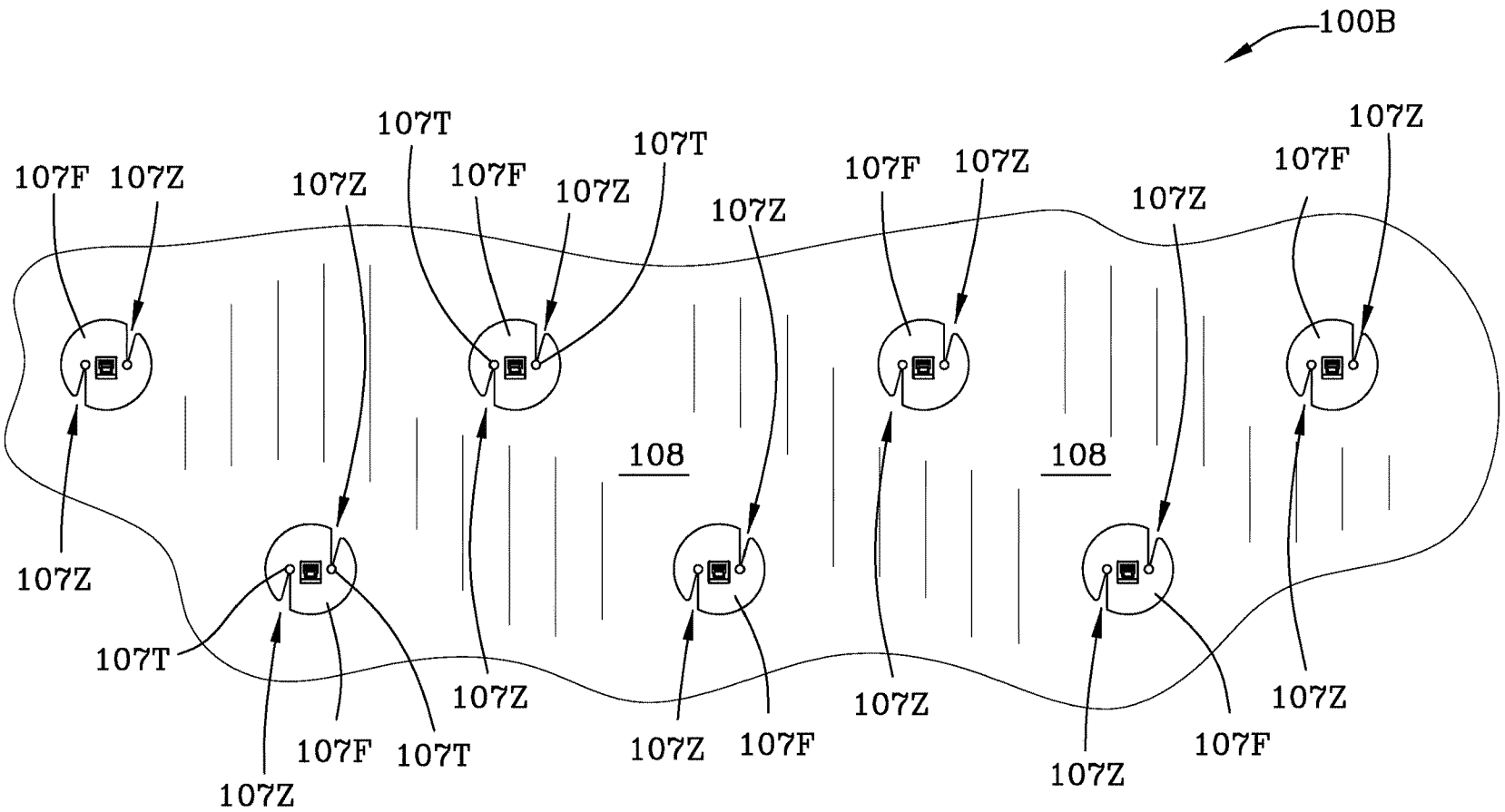
FIG. 1B is a cross-sectional view taken along the lines of FIG. 1.
Figure 1C:
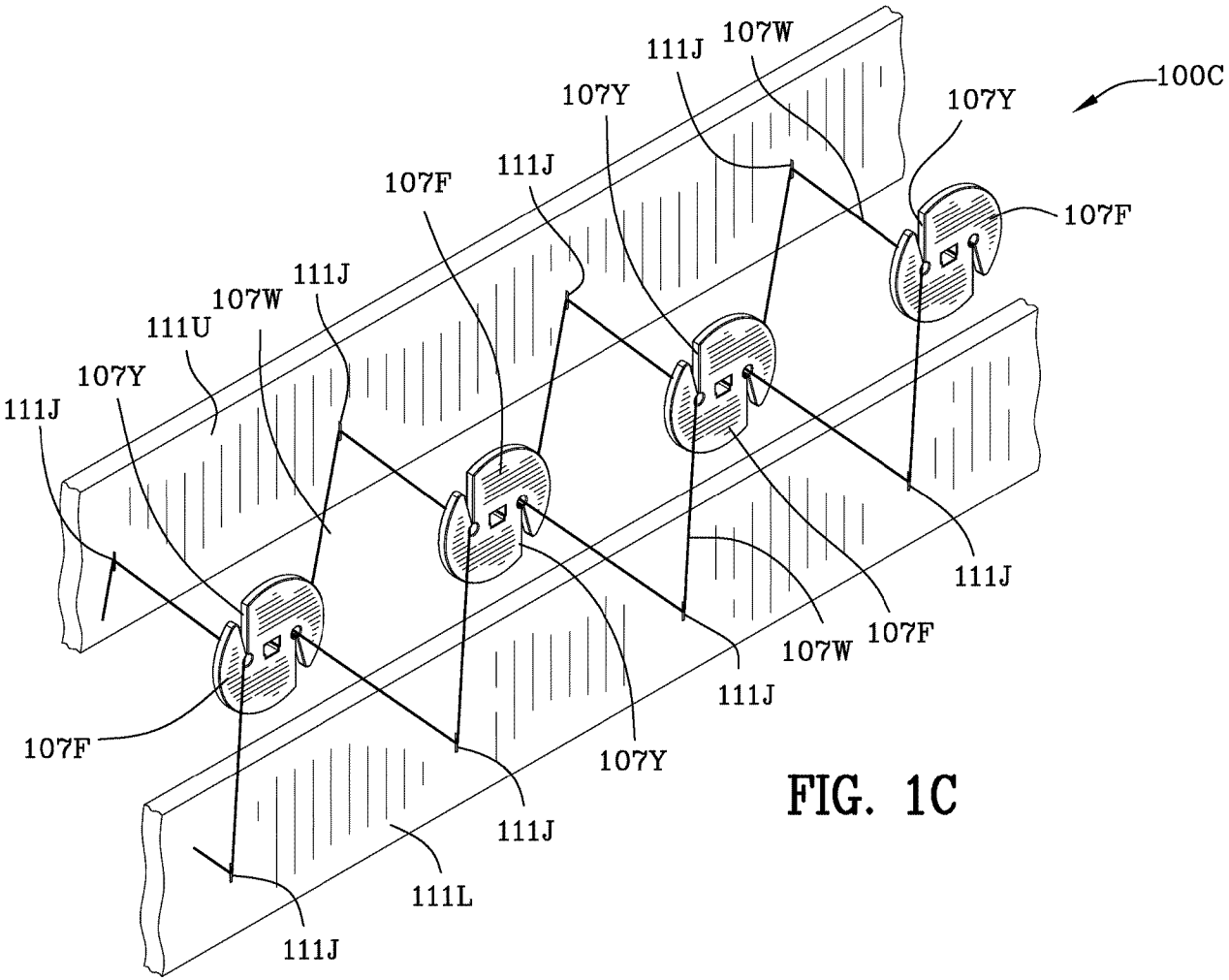
FIG. 1C is a perspective view of a portion of the chair structure illustrating upper wooden supports and lower wooden supports.
Figure 1D:
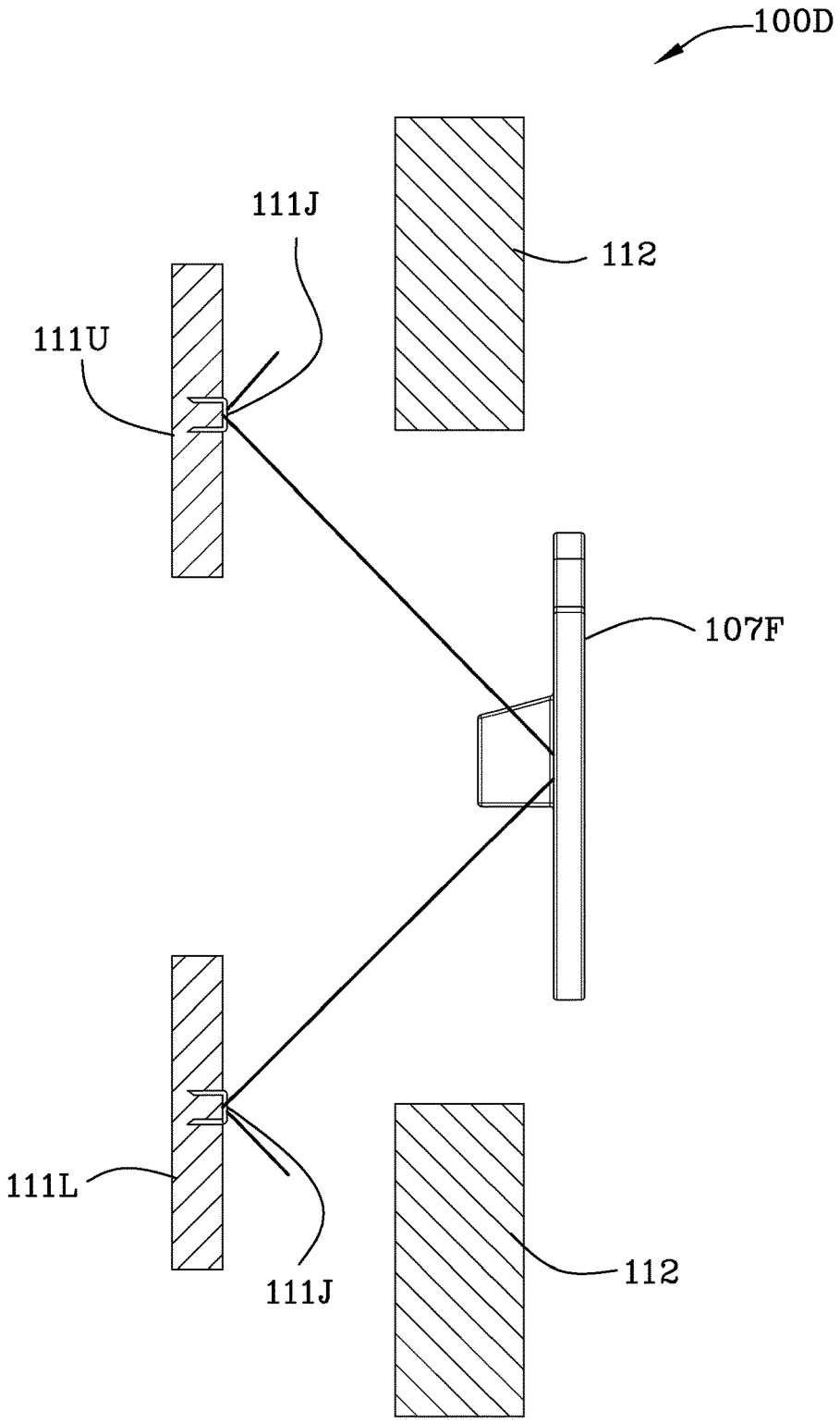
FIG. 1D is a schematic cross-sectional view of upper wooden support, lower wooden support, string and frame member.
Figure 1E:
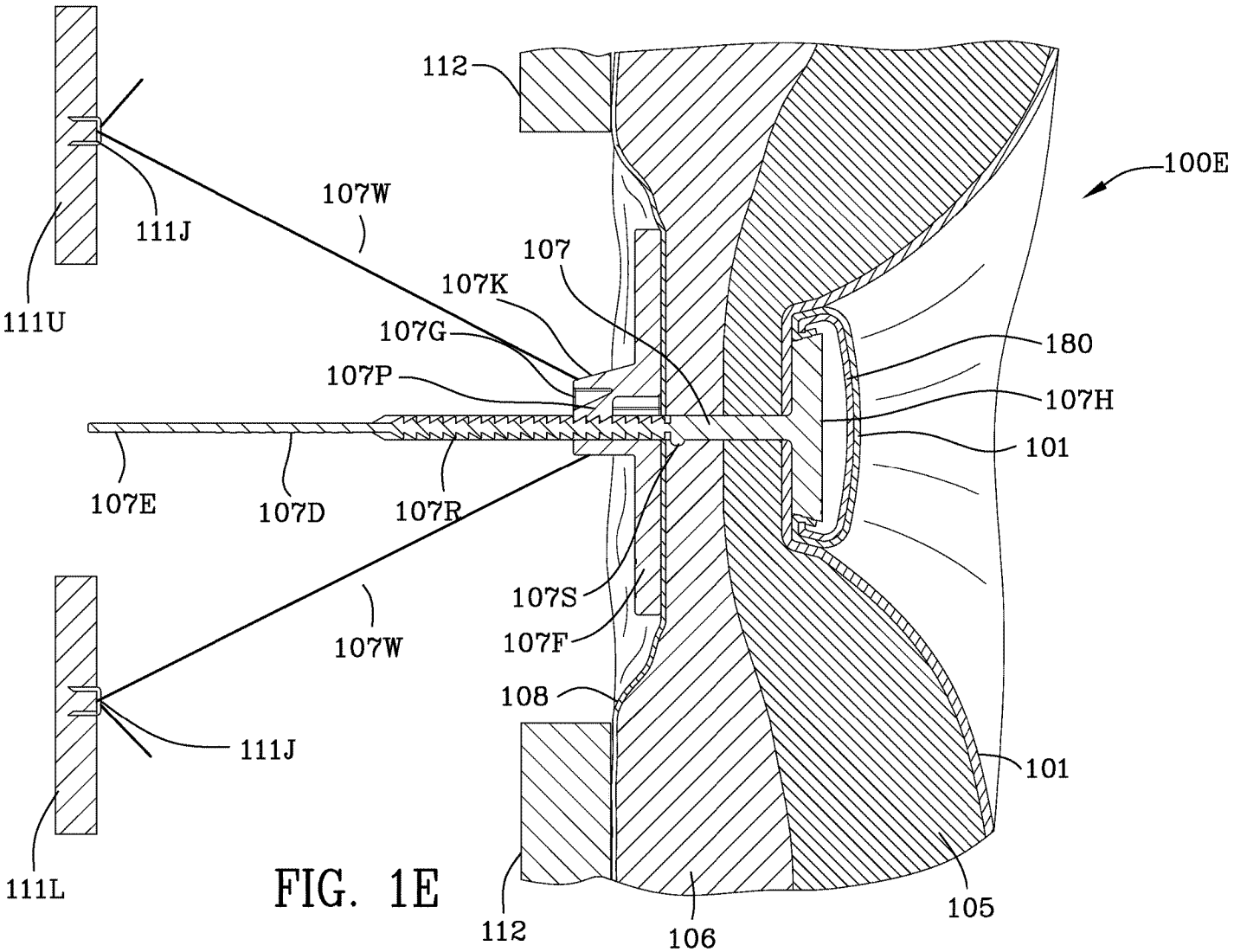
FIG. 1E is a schematic cross-sectional view similar to FIG. 1A shown with the structure of FIG. 1D.

FIG. 1D is a schematic cross-sectional view 100D of upper wooden support 111U, lower wooden support 111L, staples 111J affixed to the upper wooden support 111U and the lower wooden support 111L, string 107W affixed by the staples 111J to the upper wooden support 111U and lower wooden support 111L. FIG. 1D also illustrates frame member 112. FIG. 1E is a schematic cross-sectional view 100E similar to FIG. 1A shown with the structure of FIG. 1D. FIG. 1E illustrates string 107W restraining flange 107F against rightward movement and securing the flange with respect to the chair frame member 112 and the upper wooden support 111U and the lower wooden support 111L.

FIG. 1B is a cross-sectional view 100B taken along the lines 1B-1B of FIG. 1. FIG. 1C is a perspective view 100C of a portion of the chair structure illustrating upper wooden supports 111U and lower wooden supports 111L FIG. 1B illustrates backing fabric 108 and several flanges 107F. Each flange 107F includes openings 107Z in button locking member 107F and thread holes 107T. Openings 107Z include walls 107Y which allow easy insertion of string 107W into thread holes 107T. Openings 107Z communicate with thread holes 107T. Holes 107T are used to secure string 107W as illustrated in FIGS. 1C, 1D and 1E. Shapes other than holes may be used to secure strings 107W. Strings 107W position the flanges 107W and the tufts 104 as desired and secure the button head 107H, the shaft 107, and the flange 107F with respect to the frame members 112, 111U, and 111L. Optionally, springs may be added in strategic locations of the chair structure.

Pawl housing 107K is shaped to allow pad 107P room to move in response to the incoming ridges 107R of the ratchet portion of the shaft 107. Rail 107L is illustrated in FIGS. 3 and 3A.

Figure 3:
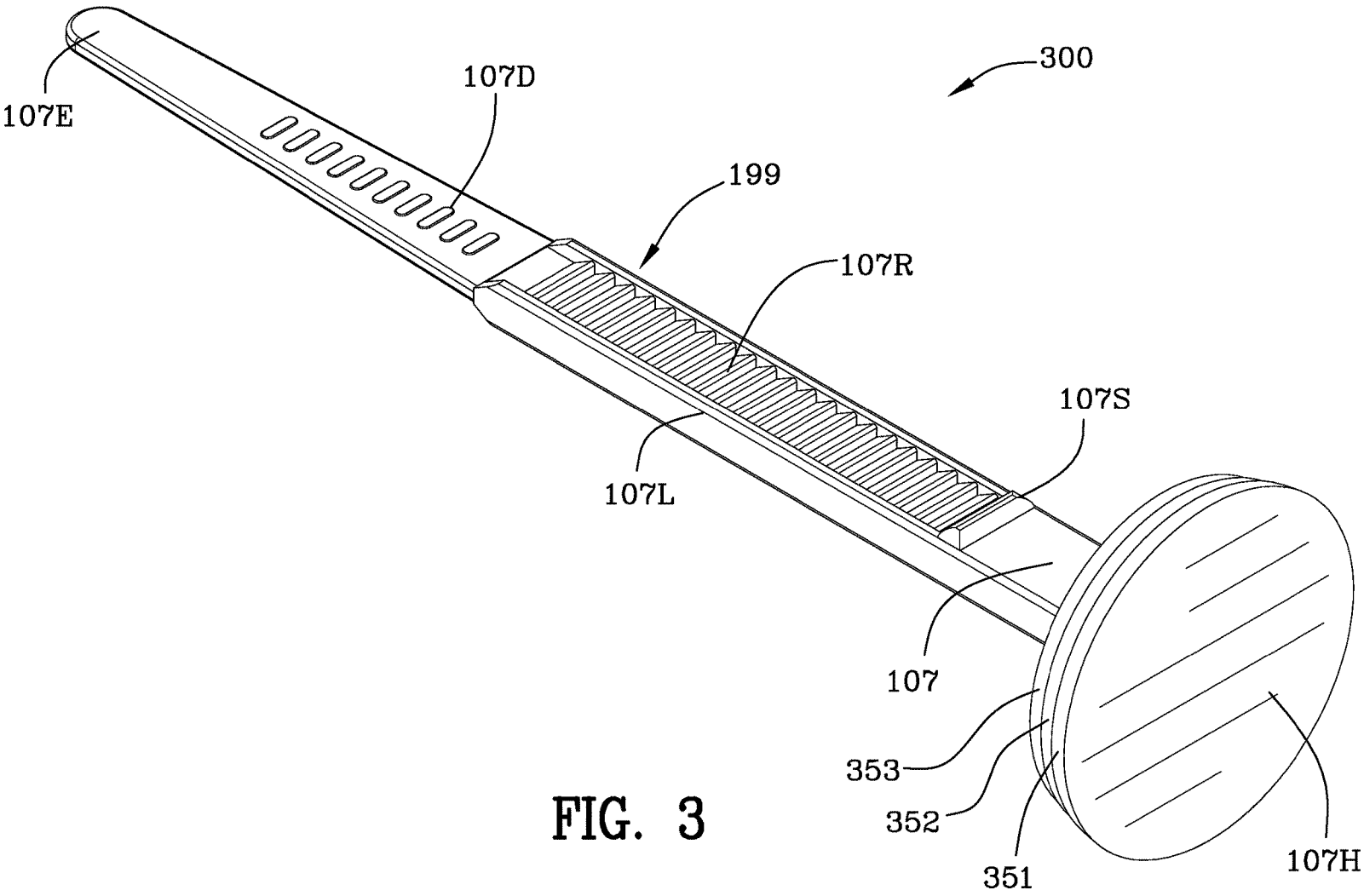
FIG. 3 is a perspective view of the button head and the shaft extending therefrom.
Figure 3A:
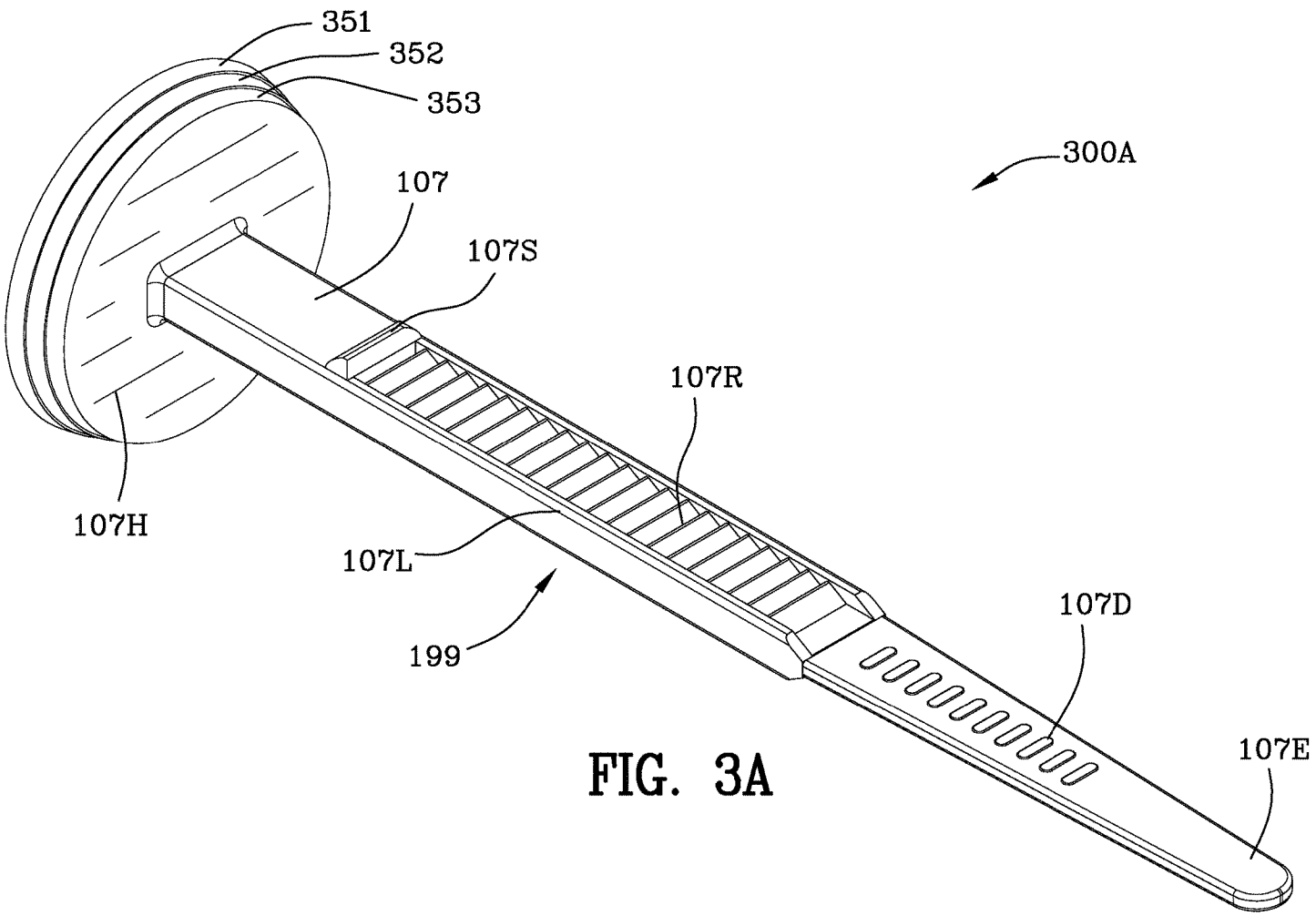
FIG. 3A is a perspective view of the button head and the shaft extending therefrom.

FIG. 3 is a perspective view 300 of the button head 107H and the shaft 107 extending therefrom. Depressions 107D are illustrated in FIG. 3 and they enable better gripping of the shaft 107 as it is pulled through passageway 121 shown in FIG. 1A. FIG. 3A is a perspective view 300A of the button head 107H and the shaft 107 extending therefrom.

The insertion depth of the button head 107H is controlled by protrusion 107S on shaft 107. As shaft 107 is inserted in flange 107F, the insertion continues until protrusion 107S engages backing fabric 108 and flange 107F. Then string 107W is installed in and through openings 107Z and thread holes 107T in the flange. String 107W is then secured by staples 111J as illustrated in FIGS. 1D and 1E and tension is applied as required. FIG. 1F is a skeleton schematic view without the pads/cushions 105, 106 shown.

As the ridges 107R of the shaft enter the pawl housing 107K, pawl 107P moves into gap 107G to allow clearance of the ridges 107R. Pressure is applied to the head portion 107H as the ridges 107R of the shaft 107 are inserted into the pawl 107P. It is necessary to apply pressure to the button head 107H because the foam pads/cushions 105, 106 are compressed by the button head 107H and the flange 107F thereby offering some resistance to the insertion of the shaft 107 into the pawl. Preferably the flange 107F, the centrally located pawl housing 107K and the pawl 107P are made of plastic. Alternatively, the flange 107F, the pawl housing 107K and the pawl could be made of metal. Similarly, the shaft 107 and the ratchet portion of the shaft having ridges 107R could also be made of metal.

Figure 3B:
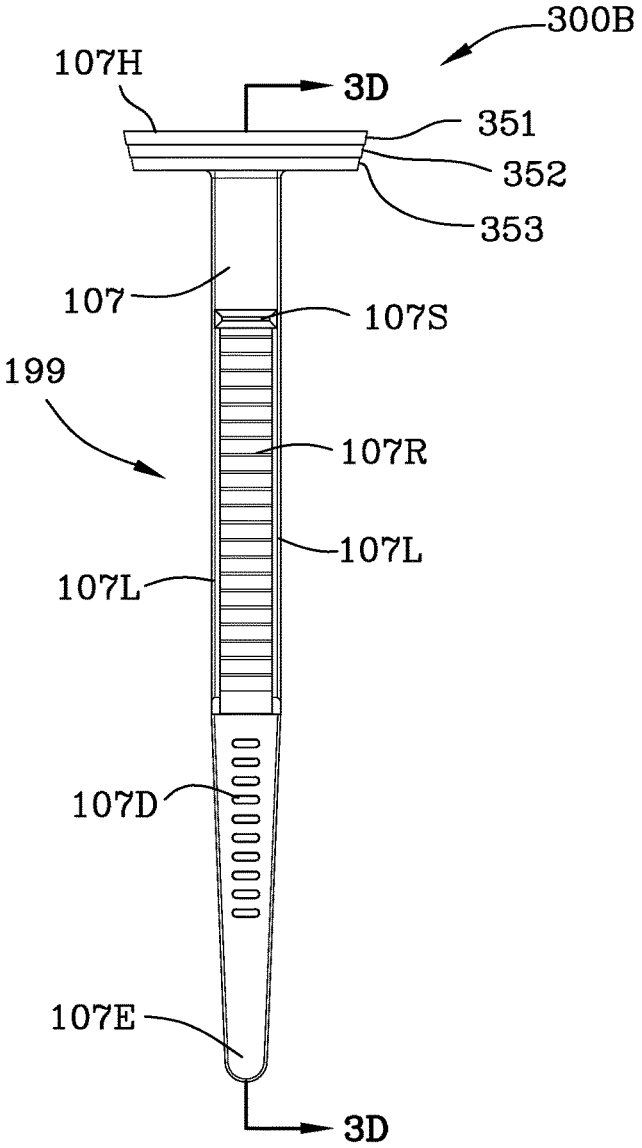
FIG. 3B is a top view of the button head and the shaft extending therefrom.
Figure 3C:
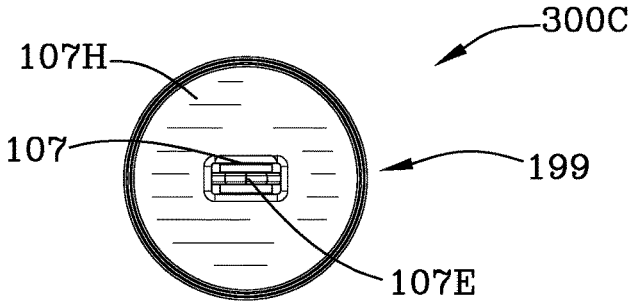
FIG. 3C is an end view of the button head and the shaft extending therefrom.
Figure 3D:
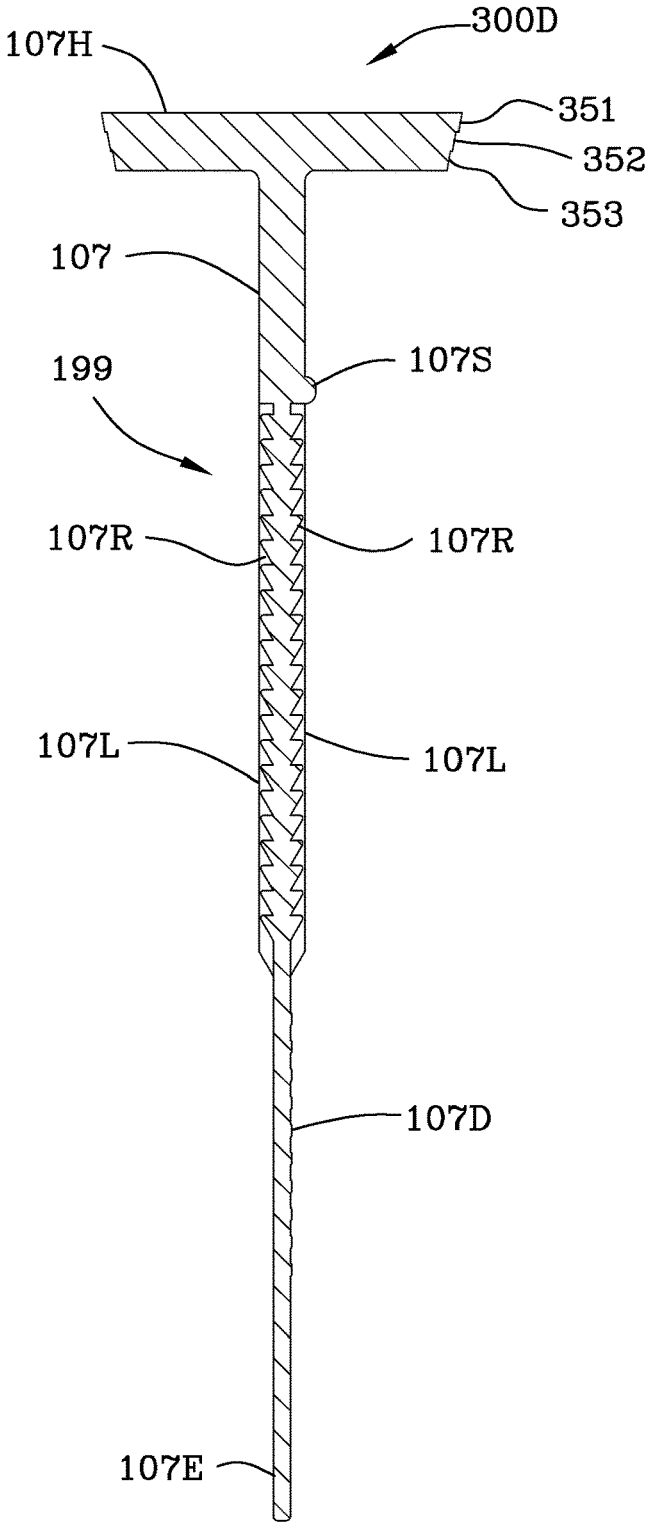
FIG. 3D is a cross sectional view taken along the lines 3D-3D of FIG. 3B.

FIG. 3B is a top view 300B of the button head 107H and the shaft 107 extending therefrom. FIG. 3C is an end view 300C of the button head 107H and the shaft 107 extending therefrom. FIG. 3D is a cross sectional view 300D taken along the lines 3D-3D of FIG. 3B. Button head 107H may be of any color.

Figure 3E:
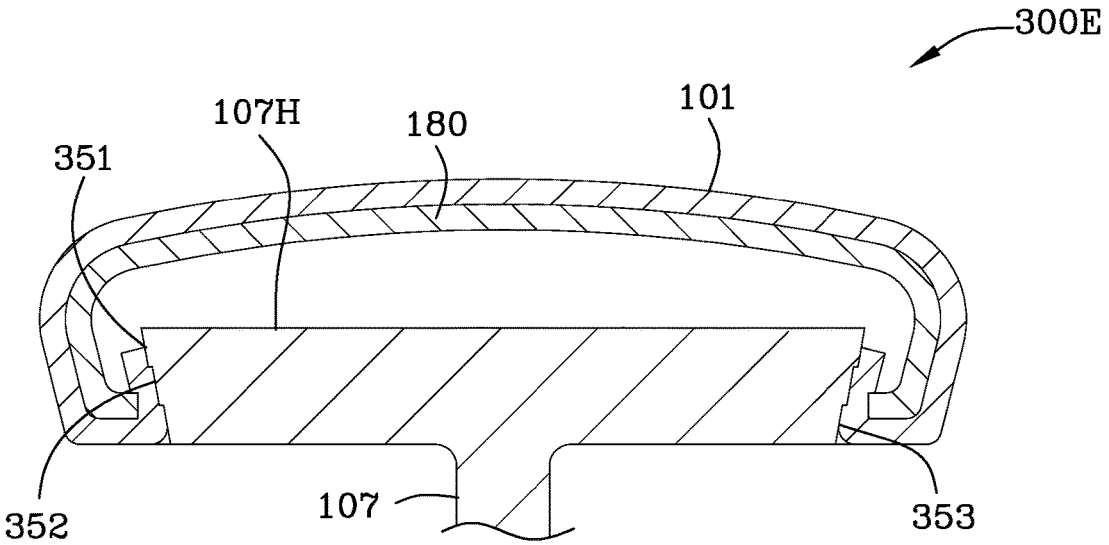
FIG. 3E is a cross-sectional view of the cap with fabric thereover which is attached to the button head.

Alternatively, a cap 180 may be placed over the plastic head 107H. Cap 180 may have a fabric cover 101 secured to the cap and the fabric cover may match the fabric used over the chair/furniture. Fabric cover 101 may be affixed to the cap 180 by a variety of means including by adhesive means or by cinching the fabric cover 101 to the cap 180. Cap 180 may be adhered to the head 107H through adhesive means. Alternatively, cap 180 may include first groove 181, second groove 182, and third groove 183 which interfit with first tapered ridge 351, second tapered ridge 352, and third tapered ridge 353, respectively, of the plastic head 107H. Thus the cap 180 and head 107H are secured together as illustrated in FIGS. 3E and 3F. FIG. 3E is a cross-sectional view 300E of the cap 180 with fabric 101 thereover which is attached to the button head 107H. Also see, FIGS. 1A and 1E which illustrate cap 180 and fabric cover 101 residing over the button head 107H.

FIGS. 1A and 1E illustrate cap 180 and fabric cover 101 residing over the button head 107H.

Figure 2A:
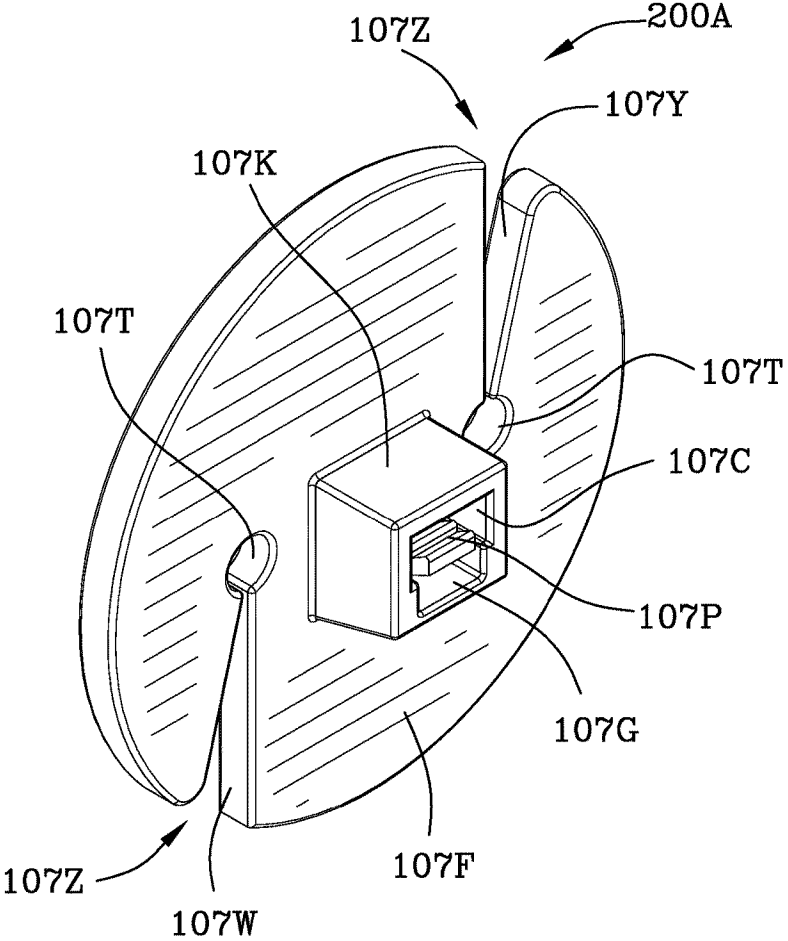
FIG. 2A is a perspective view of the button locking member.
Figure 2:
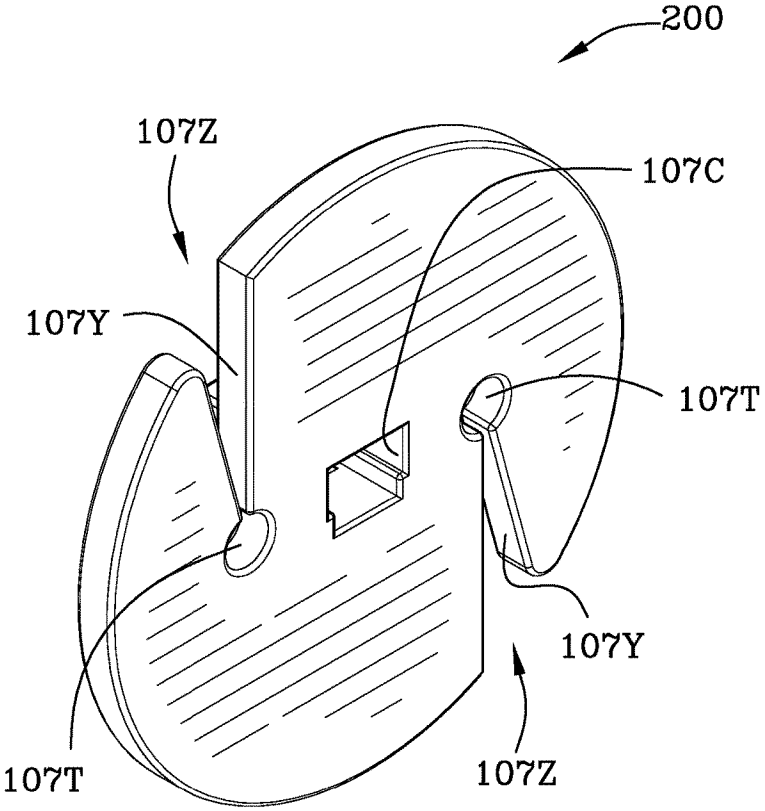
FIG. 2 is a perspective view of the button locking member.
Figure 2B:
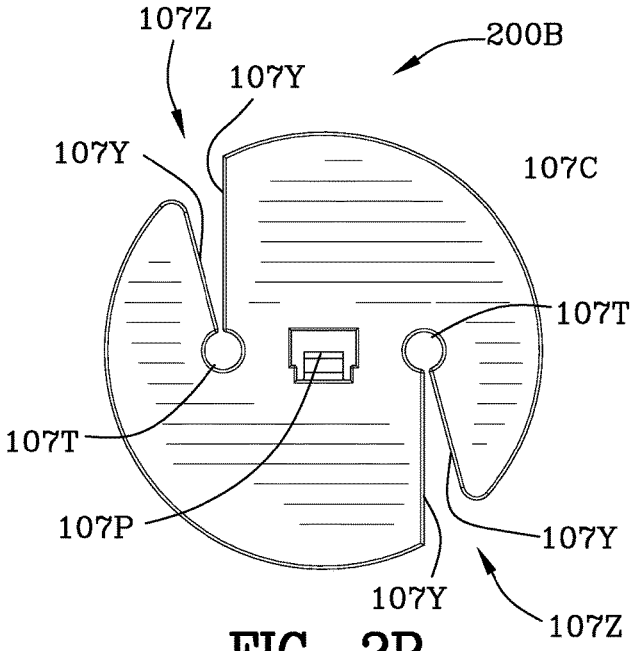
FIG. 2B is a first end view of the button locking member.
Figure 2C:
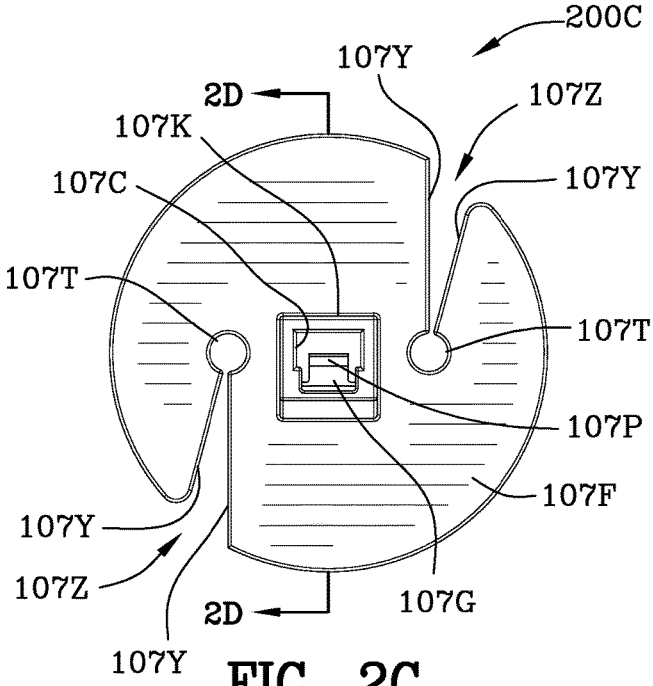
FIG. 2C is a second end view of the button locking member.
Figure 2D:
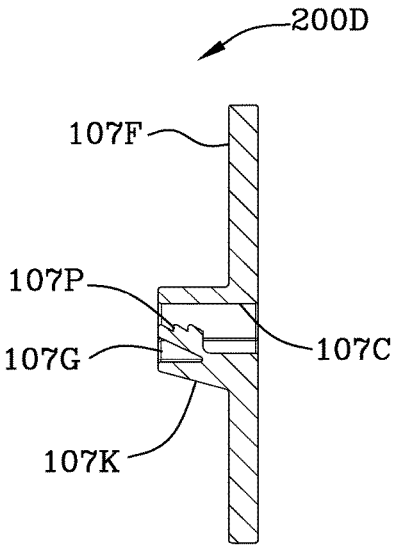
FIG. 2D is a cross sectional view of the button locking member taken along the lines 2D-2D.

Referring to FIGS. 1E, 2D and 3D, ridges 107R reside on both the upper and lower sides of the shaft 107 enabling easy insertion of shaft 107 into the locking member without regard to orientation of the shaft before inserting the shaft into pawl 107P.

FIG. 2 is a perspective view 200 of the button locking member 107F. Channel 107C is illustrated in FIG. 2. Shaft 107 is guided by guide rails 107L and channel 107C when entering locking member 107F for engagement with pawl 107P. FIG. 2A is another perspective view 200A of the button locking member 107F and illustrates gap 107G into which pawl 107P moves as shaft 107 moves in the locking member/flange 107F. FIG. 2B is a first end view 200B of button locking member 107F illustrating openings 107Z and walls 107Y which form the openings 107Z. Thread holes 107T are also illustrated in FIG. 2B. FIG. 2C is a second end view 200C of button locking member 107F. FIG. 2C is viewed from the end of the pawl housing 107K and pawl 107P is easily seen in this view. Channel 107C is viewed in FIGS. 2B, 2C and 2D. FIG. 2D is a cross sectional view 200D of button locking member 107F taken along the lines 2D-2D and illustrates channel 107C, pawl 107P, gap 107G providing space for pawl 107P movement, and the pawl housing 107K.

As previously stated, tufting button 199 and locking member 107F are disclosed. A tufting button 100 and locking member 107F in combination with a furniture cushion 105, 106 and fabric 101 thereover are also disclosed. A tufting button 199 and locking member 107F in combination with a furniture cushion 105, 106 and fabric 101 thereover, and further in combination with a frame members 112, 111L, and 111U are also disclosed. The tufting button 199 includes a head 107H and an elongated shaft 107. The elongated shaft 107 includes a ratchet portion, and the ratchet portion includes a plurality of ridges 107R therein. The locking member includes a pawl 107P. The elongated shaft resides, partially, within the locking member. A portion of the plurality of ridges 107R engages the pawl 107P of the locking member 107F. Preferably the tufting button 199 is plastic and the locking member 107F is plastic.

The locking member 107F is flange shaped meaning it is generally circularly shaped in cross section and has a thickness making it generally in the shape of a thin cylinder. The elongated shaft 107 includes a protrusion 107S thereon and the protrusion 107S of the elongated shaft 107 is a stop limiting the depth of insertion of the elongated member 107 into the pawl 107P of the locking member 107F.

The locking member 107F includes a centrally located pawl housing 107K and the pawl 107P resides within the centrally located pawl housing 107K. Also, the centrally located pawl housing 107K includes a gap 107G therein enabling the pawl 107P to move in response to adjustment of the plurality of ridges 107R of the ratchet portion of the shaft 107 of the tufting button 199 relative to the pawl 107P. A portion of the plurality of ridges 107R engages the pawl 107P of the locking member compressing the furniture cushion 105, 106.

The frame member 112, 111L, 112U supports the furniture cushion 105 and fabric 101 thereover. An attachment string 107W adjustably connects the locking member 107F and the frame member 112, 111L, 111U together to position the tufting button 199 relative to the furniture cushion 105, 106 and fabric thereover.

A process for positioning a tufting button 199 and a locking member 107F in furniture fabric 101 residing over a cushion 195, 106, the tufting button 199 includes a head 107H and an elongated shaft 107, the elongated shaft 107 includes a ratchet portion, the ratchet portion includes a plurality of ridges 107R therein, the locking member 107F includes a pawl 107P, and the furniture fabric 101 is supported by the cushion 105, 106 and a furniture frame 111L, 111U, 112 comprising the steps of: puncturing a hole 121 in the furniture fabric 101 and the cushion 105, 106; inserting the elongated shaft 107 into and through the hole 121 in the furniture fabric 101 and the cushion 105, 106; inserting the ratchet portion of the elongated shaft 107 into and through the pawl 107P of the locking member 107F; locking the elongated shaft 107 of the tufting button 199 with the pawl 107P of the locking member 107F, the elongated shaft resides, partially, within the pawl 107P of the locking member 107F; compressing the furniture cushion 105, 106, and, a portion of the plurality of ridges 107R engages the pawl 107P of the locking member 197F; and, engaging the stop 107S of the elongated shaft 107 with the flange 107F limiting the depth of insertion of the elongated shaft 107 into the pawl 107P of the locking member 107F thus limiting the extent of compression of the furniture cushion 105, 106.

REFERENCE NUMERALS

100 perspective view of chair illustrated in FIG. 1
100A cross-sectional view taken along the lines 1A-1A of FIG. 1
100B cross-sectional view taken along the lines 1B-1B of FIG. 1
100C perspective view of a portion of the chair structure illustrating upper wooden supports 111U and lower wooden supports 111L
100D schematic cross-sectional view of upper wooden support 111U, lower wooden support 111L, string 107W and frame member 112
100E schematic cross-sectional view similar to FIG. 1A shown with the structure of FIG. 1D
101 upholstery fabric on back of chair
102 upholstery fabric on seat of chair
103 upholstery fabric on chair rail
104 arrow indicating a tufted region of the chair
105 first foam pad
106 second foam pad
107 shaft of button 107H
107C channel in flange 107F and in centrally located housing 107K
107D depressions in narrow threading end portion 107E of shaft 107 of button 107H
107E narrow threading end portion of shaft 107 of button 107H
107F button locking member
107G gap allowing space for pawl 107P movement
107H button head
107K pawl housing
107L rail on shaft 107
107P pawl portion of button locking member 107F
107R ratchet portion of button shaft having ridges thereon
107S protrusion on shaft 107
107T thread hole in button locking member 107F
107W string for positioning button head 107Z opening in button locking member 107F
107Y walls of slot 107Z
107Z slot/opening for receiving string 107W
108 backing fabric
111J staple
111L lower wooden support
111U upper wooden support
112 chair frame member
121 hole punctured through first foam pad/cushion 105 and second foam pad/cushion 106

180 cap with fabric thereover
181 first interior groove in cap 180
182 second interior groove in cap 180
183 third interior groove in cap 180
200 perspective view of the button locking member 107F
200A perspective view of the button locking member 107F
200B first end view of button locking member 107F
200C second end view of button locking member 107F
200D cross sectional view of button locking member 107F taken along the lines 2D-2D
300 perspective view of the button head 107H and the shaft 107 extending therefrom
300A perspective view of the button head 107H and the shaft 107 extending therefrom
300B top view of the button head 107H and the shaft 107 extending therefrom
300C end view of the button head 107H and the shaft 107 extending therefrom
300D cross sectional view taken along the lines 3D-3D of FIG. 3B
351 first ridge on button head 107H
352 second ridge on button head 107H
353 third ridge on button head 107H

The invention claimed is:

1. A tufting button and locking member, comprising:
said tufting button includes an integral head and an elongated shaft, said elongated shaft includes a solid ratchet portion, said solid ratchet portion includes a plurality of ridges thereon, said plurality of ridges protrude from said solid ratchet portion of said elongated shaft;
said locking member includes a flange and a pawl;
said flange is cylindrically shaped;
said elongated shaft resides, partially, within said locking member;
a portion of said plurality of ridges of said solid ratchet portion engages said pawl of said locking member;
said elongated shaft includes a protrusion thereon;
said protrusion of said elongated shaft is a stop limiting the depth of insertion of said elongated shaft into said pawl of said locking member; and,
said stop engages said cylindrically shaped flange of said locking member thus limiting said depth of insertion of said elongated shaft into said pawl of said locking member.

2. A tufting button and locking member, in combination with a furniture cushion and fabric thereover, comprising:
said tufting button includes an integral head and an elongated shaft, said elongated shaft includes a solid ratchet portion, said solid ratchet portion includes a plurality of ridges thereon;
said locking member includes a flange and a pawl;
said flange is cylindrically shaped;
said elongated shaft of said tufting button inserted into and through said furniture cushion and fabric thereover, said elongated shaft of said tufting button inserted into and through said locking member, said elongated shaft resides, partially, within said locking member;
a portion of said plurality of ridges of said solid ratchet engages said pawl of said locking member compressing said furniture cushion;
said elongated shaft includes a protrusion thereon;
said protrusion of said elongated shaft is a stop limiting the depth of insertion of said elongated shaft into said pawl of said locking member;
said stop engages said flange of said locking member thus limiting said depth of insertion of said elongated shaft into said pawl of said locking member; and,
said stop engages said cylindrically shaped flange of said locking member thus limiting said compression of said cushion.

3. A tufting button and locking member as claimed in claim 1 where said tufting button is plastic and said locking member is plastic.

4. A tufting button and locking member, as claimed in claim 1, further comprising:
said locking member includes a centrally located pawl housing and said pawl residing within said centrally located pawl housing; and, said centrally located pawl housing includes a gap therein enabling said pawl to move in response to adjustment of said plurality of ridges of said solid ratchet portion of said elongated shaft of said tufting button relative to said pawl.

5. A tufting button and locking member, as claimed in claim 3, further comprising:
said locking member includes a centrally located pawl housing and said pawl residing within said centrally located pawl housing; and, said centrally located pawl housing includes a gap therein enabling said pawl to move in response to adjustment of said plurality of ridges of said solid ratchet portion of said elongated shaft of said tufting button relative to said pawl.

6. A tufting button and locking member in combination with a furniture cushion and fabric thereover as claimed in claim 2 where said tufting button is plastic and said locking member is plastic.

7. A tufting button and locking member in combination with a furniture cushion and fabric thereover as claimed in claim 2, further comprising:
said locking member includes a centrally located pawl housing and said pawl residing within said centrally located pawl housing; and, said centrally located pawl housing includes a gap therein enabling said pawl to move in response to adjustment of said plurality of ridges of said solid ratchet portion of said elongated shaft of said tufting button relative to said pawl.

8. A tufting button and locking member in combination with a furniture cushion and fabric thereover as claimed in claim 6, further comprising:
said locking member includes a centrally located pawl housing and said pawl residing within said centrally located pawl housing; and, said centrally located pawl housing includes a gap therein enabling said pawl to move in response to adjustment of said plurality of ridges of said solid ratchet portion of said elongated shaft of said tufting button relative to said pawl.

9. A tufting button and locking member in combination with a furniture cushion and fabric thereover as claimed in 2, further comprising:
a frame member, said frame member supports said furniture cushion and fabric thereover; and,
an attachment string adjustably connected to said locking member to position said tufting button relative to said furniture cushion, fabric thereover, and said frame member.

10. A tufting button and locking member as claimed in claim 1 where said solid ratchet portion of said shaft includes a plurality of ridges on a first side of said shaft and on a plurality of ridges second side of said shaft.

* * * * *